United States Patent [19]

Meno

[11] Patent Number: 4,635,518

[45] Date of Patent: Jan. 13, 1987

[54] SEGMENTED FRET ELECTRONIC MUSICAL INSTRUMENT

[76] Inventor: Frank Meno, 365 S. Atlantic Ave., Pittsburgh, Pa. 15224

[21] Appl. No.: 642,205

[22] Filed: Aug. 20, 1984

[51] Int. Cl.[4] ..... G10H 3/18

[52] U.S. Cl. ..... 84/1.16; 84/DIG. 30; 84/1.1; 84/1.27

[58] Field of Search ..... 84/1.01, 1.04, 1.16, 84/1.27, DIG. 30, DIG. 24, 1.1, 179, 314 R

[56] References Cited

U.S. PATENT DOCUMENTS

| | | | |
|---|---|---|---|
| 3,217,079 | 11/1965 | Murell | 84/DIG. 30 |
| 3,465,086 | 9/1969 | Borell | 84/1.16 |
| 3,482,029 | 12/1969 | Sines | 84/1.16 |
| 3,530,227 | 9/1970 | Wheeler et al. | 84/1.16 |
| 4,213,367 | 7/1980 | Moog . | |
| 4,245,539 | 1/1981 | Jones | 84/1.27 |

FOREIGN PATENT DOCUMENTS

| | | | |
|---|---|---|---|
| 156524 | 4/1978 | Netherlands | 84/DIG. 11 |

*Primary Examiner*—Stanley J. Witkowski
*Assistant Examiner*—David Warren
*Attorney, Agent, or Firm*—Arnold B. Silverman

[57] ABSTRACT

An electronic stringed musical instrument having an electrically insulating fingerboard is disclosed. The fingerboard is provided with a number of segmented frets attached across its upper surface at desired points along its length. Each of the frets includes a number of electrically conducting fret segments each of which are electrically insulated from one another. Any number of strings may be provided on the instrument each string is disposed adjacent to and associated with a single fret segment of each of the segmented frets. A top-octave generator and octave dividers are utilized to selectively provide a fret segment of one of the frets with an electrical signal of at least one known referencing frequency. The strings are attached to the instrument in a spaced relationship with respect to the fret segments. Displacing a string to contact one of the fret segments completes an electrical circuit having at least one frequency equal to a frequency of the signal provided to that fret segment. Displacing the same string to contact a different fret segment completes a different electrical circuit having at least one different frequency. Simultaneously depressing a plurality of the strings simulataneously completes a number of electrical circuits each capable of producing a number of different frequencies. The amplitude output of the instrument is dependent upon the voltage applied to each of the strings and is controlled by hand operated transducers.

18 Claims, 5 Drawing Figures

SEGMENTED FRET ELECTRONIC MUSICAL INSTRUMENT

BACKGROUND OF THE INVENTION

This invention relates to an electronic musical instrument having segmented frets. More specifically, a top-octave generator and a series of frequency dividers and voltage controls are utilized to provide means for varying frequency and amplitude when a string is contacted to any particular fret segment, thus, generating desired musical tones.

DESCRIPTION OF THE PRIOR ART

It is known in the art to utilize a fretted stringed instrument and associated electronic circuitry for sequentially providing voltage signals for driving a voltage controlled generator. In U.S. Pat. No. 4,038,897, for example, different electrical voltages are applied to the instrument frets so as to apply such voltage to the strings when the strings are pressed into contact with the frets. That system, however, may only be utilized to provide one note at a time, because the conducting frets on that instrument extend completely across the fingerboard. When the instrument has more than one string, the string voltages are sampled repetitively by a multiplexer and offset voltages are added by adding a circuit to the string voltages to account for the musical intervals between the open strings. A peak detector passes on only the highest voltage produced by the added circuit during one sampling cycle and, therefore, avoids ambiguity caused by two or more strings being simultaneously pressed into contact with the frets.

U.S. Pat. No. 4,306,480 discloses an electronic musical instrument having a fret board and a plurality of conductive frets which are coupled to a resistance ladder of discrete resistance elements. Contacting a conducting string to any particular fret completes an electric circuit including a voltage controlled oscillator which generates a tone which is dependent upon the amount of resistance in the circuit.

U.S. Pat. No. 4,235,141 and applicant's earlier U.S. Pat. No. 4,330,918 each provide electronic musical instruments which also utilize the concept of varying the resistance in an electrical circuit to provide musical tones having frequencies which depend upon the resistance downstream of a particular contact point. Because each of these devices utilize resistance elements to control the frequency, the strings or resistance elements typically must be provided in a particular length to obtain the desired flexibility in frequency variation.

Each of the instruments which utilize resistance to control frequency require extensive planning to provide an appropriate resistance element or series of elements which have resistance values which will provide the desired frequencies at various points along the length of a fingerboard of the instrument.

U.S. Pat. No. 4,176,576 discloses an electronic musical instrument in which a keyboard circuit generates scale tone voltage signals corresponding to depressed keys of a keyboard. This instrument includes plural musical tone forming when plural keys are simultaneously depressed voltage signals corresponding to the respective keys are generated at respective connecting points of resistance circuits associated with the plural tone forming sections. This instrument, however is designed for use with a keyboard rather than for a single stringed instrument.

There remains, therefore, a need for a fretted stringed instrument which is capable of providing a plurality of simultaneous tones. There further remains a need for such an instrument which includes a voltage controlled amplitude. There still further remains a need for such an instrument which is simple in its design and which can utilize a number of existing components thereby minimizing the overall cost of the instrument.

SUMMARY OF THE INVENTION

The present invention provides a solution to the above-identified needs by providing an electronic stringed musical instrument having a plurality of segmented frets attached across its fingerboard at desired points along its length. By segmenting the frets, each of the instrument's conducting strings may be electrically insulated from one another thereby making possible the playing of several simultaneous tones. A controlled voltage is provided for each string and each of the fret segments is provided with an electrical signal of a known reference frequency. A series of frequency dividers are utilized to supply the appropriate frequency to the various fret segments below each string along the length of the fingerboard. The strings are attached to the instrument in a spaced relationship with respect to its associated fret segments in a manner whereby displacing a string to contact any fret segment completes an electrical circuit that generates an output frequency exactly equal to the frequency of the signal provided to that fret segment. Displacing the same string to contact a different fret segment completes a different electrical circuit having a different frequency. Simultaneously depressing a plurality of strings simultaneously completes a plurality of electrical circuits each capable of having a different frequency.

An amplitude control means is provided to control the amplitude of the electrical signals emitted at the fret locations of each of the strings and may comprise a plurality of pressure transducers one associated with each string. Providing a conducting elastomer over each of the fret signals is an alternative means to control the amplitude of the instrument. With that system, applying a varying force to the conducting elastomer provides varying resistance in a completed circuit.

It is an object of the present invention to provide a stringed electronic musical instrument which is capable of simultaneously playing a plurality of tones.

It is another object of the present invention to provide such a musical instrument which does not rely on the resistance in a particular circuit to determine the frequency of the instrument's output.

It is an object of the invention to provide an electronic musical instrument in which the frequency provided to any particular fret segment is obtained by the use of a series of frequency dividers to supply the appropriate frequency to a given fret segment.

It is yet another object of the invention to provide a musical instrument in which the voltage on the string controls the intensity of sound.

It is yet another object of the present invention to provide an electronic musical instrument in which the frequency of a particular tone is not dependent upon the length of the string or the spacing between the frets.

It is yet another object of the invention to provide an instrument which reduces electrical noise.

It is yet another object of the present invention to electrically insulate the various strings of the instrument by providing a plurality of segmented frets.

It is yet another object of the invention to provide an electronic musical instrument which may have any desired physical configuration.

It is yet another object of the invention to provide means for physically constraining the strings so that accidental contacts with the frets are prevented.

These and other objects of the invention will be more fully understood from the following description of the invention on reference to the illustrations appended hereto.

DESCRIPTION OF THE PREFERRED EMBODIMENTS

As used herein, in the absence of a clear, express indication to the contrary at a particular location, the terms "conducting" and "insulating" refer respectively to a material's capacity to conduct or resist the conduction of an electrical current.

The present invention provides a means of controlling frequency and amplitude of an electrical signal emitted by a crystal controlled oscillator in an electronic stringed instrument, utilizing simplified circuitry. The instrument also enables the expansion of the frequency range by permitting placement of the frets in a closer pattern than is possible with other types of stringed instruments.

By segmenting the frets and configuring their position so that each string contacts only those fret segments lying beneath it, it is possible to select various frequencies along a chain of frequency dividers. By means of keys activated simultaneously, the amplitude may be controlled by the same circuit.

The present invention provides an electrical stringed instrument which utilizes an oscillator and a plurality of divider-keyers to produce distinct musical tones when a particular conducting string is depressed to contact different segmented conducting frets provided along the fingerboard of the instrument. The use of the segmented frets allows each string of the instrument simultaneously to create an individual electrical circuit and to produce a musical tone without interference from the other strings. Therefore, the present invention provides a simple and effective method of playing chords or other combinations of plural tones on the instrument.

Figure 1:
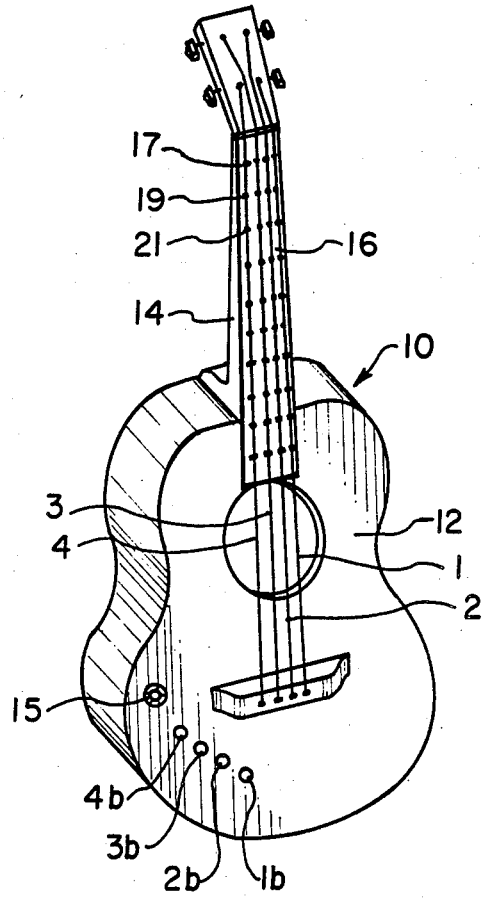
FIG. 1 is a schematic view of one form of the invention showing an electrically insulating fingerboard, conducting fret segments and conducting strings.

Referring specifically to FIG. 1, an electronic stringed musical instrument 10 is shown. In the embodiment of the invention shown, instrument 10 is in the form of a guitar and includes a body portion 12 and a neck portion 14. An electrically insulated fingerboard 16 is provided on an upper surface of neck 14. A plurality of segmented frets, such as frets 17, 19 and 21 are attached across the insulating surface of fingerboard 16. A plurality of elongated electrical conducting elements, such as electrically conducting strings 1, 2, 3 and 4 are attached to instrument 10 and are disposed adjacent to the conducting frets. A plurality of pressure transducers, equal to the number of strings, such as transducers 1*b*, 2*b*, 3*b* and 4*b*, are provided on body 12 to provide a means for controlling the amplitude of circuits associated with strings 1, 2, 3 and 4 respectively. An octave selector switch 15 is also provided on body 12.

It is to be understood that the present invention is not limited to the form shown in FIG. 1. For example, the body, neck and fingerboard of the instrument may all be combined into a single elongated member and referred to as a fingerboard. Any number of strings may be provided on the fingerboard and the instrument may have any number of frets. As will be obvious to those skilled in the art, unlike mechanical instruments the present invention relates to an electronic musical instrument and the tone produced will not be dependent upon the length of any of the strings.

Figure 2:
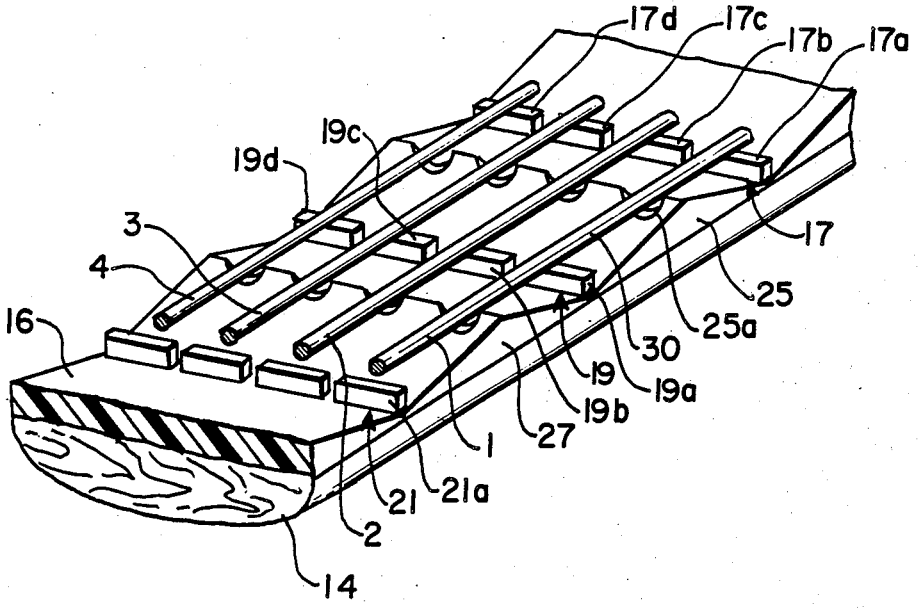
FIG. 2 is a fragmentary section of a portion of the neck and fingerboard of the instrument shown in FIG. 1.

Referring specifically to FIG. 2, a fragmentary section of a portion of the neck and fingerboard of instrument 10 is shown. Neck 14, as indicated, is provided with an insulating upper surface 16. Each fret is comprised of a plurality of fret segments equal to the number of strings. Fret 17, for example, includes fret segments 17*a*, 17*b*, 17*c* and 17*d*. Likewise, fret 19, includes fret segments 19*a*, 19*b*, 19*c* and 19*d*. Each of the fret segments is an electrical conductor and each fret segment is connected to associated electronic circuitry as will be hereinafter described. Each of the conducting strings of the instrument is disposed adjacent to and associated with a single fret segment of each of the frets. Conducting string 1, for example, is disposed adjacent to and associated with fret segments 17*a*, 19*a* and 21*a* of frets 17, 19 and 21.

The upper insulating surface 16 preferably extends upwardly at locations between adjacent frets along the length of the fingerboard to a point higher than that of the fret segments. In FIG. 2, upwardly extending portions 25 and 27 of insulating surface 16 each extend upwardly to a point higher than the uppermost portions of frets 17, 19 and 21. The upwardly extending portions of the insulating surface 16 preferably contact each of the strings and are utilized to maintain the strings in a desired spaced relationship with respect to the fret segments. In the preferred embodiment of the present invention, the upwardly extending portions of the insulating surface maintain the strings approximately 0.01 inch or within the range of 0.005 to 0.02 inches above each of the fret segments. The upwardly extending portions also prevent undesired accidental contact with adjacent fret segments of an associated string when the string is depressed to contact a desired fret segment. For example, when string 1 is depressed downwardly at point 30 to contact front segments 19*a*, upwardly extending portions 25 and 27 prevent string 1 from contacting either fret segments 17*a* or 21*a*. A channel-like groove may be provided in an uppermost portion of the upwardly extending portions to prevent an undesired degree of motion of a string in a direction laterally traverse with respect to a downward depression thereof. Channel-like groove 25*a*, for example, which extends substantially parallel with respect to the string 1, prevents undesired motion of string 1 in a lateral direction.

Figures 3, 4:
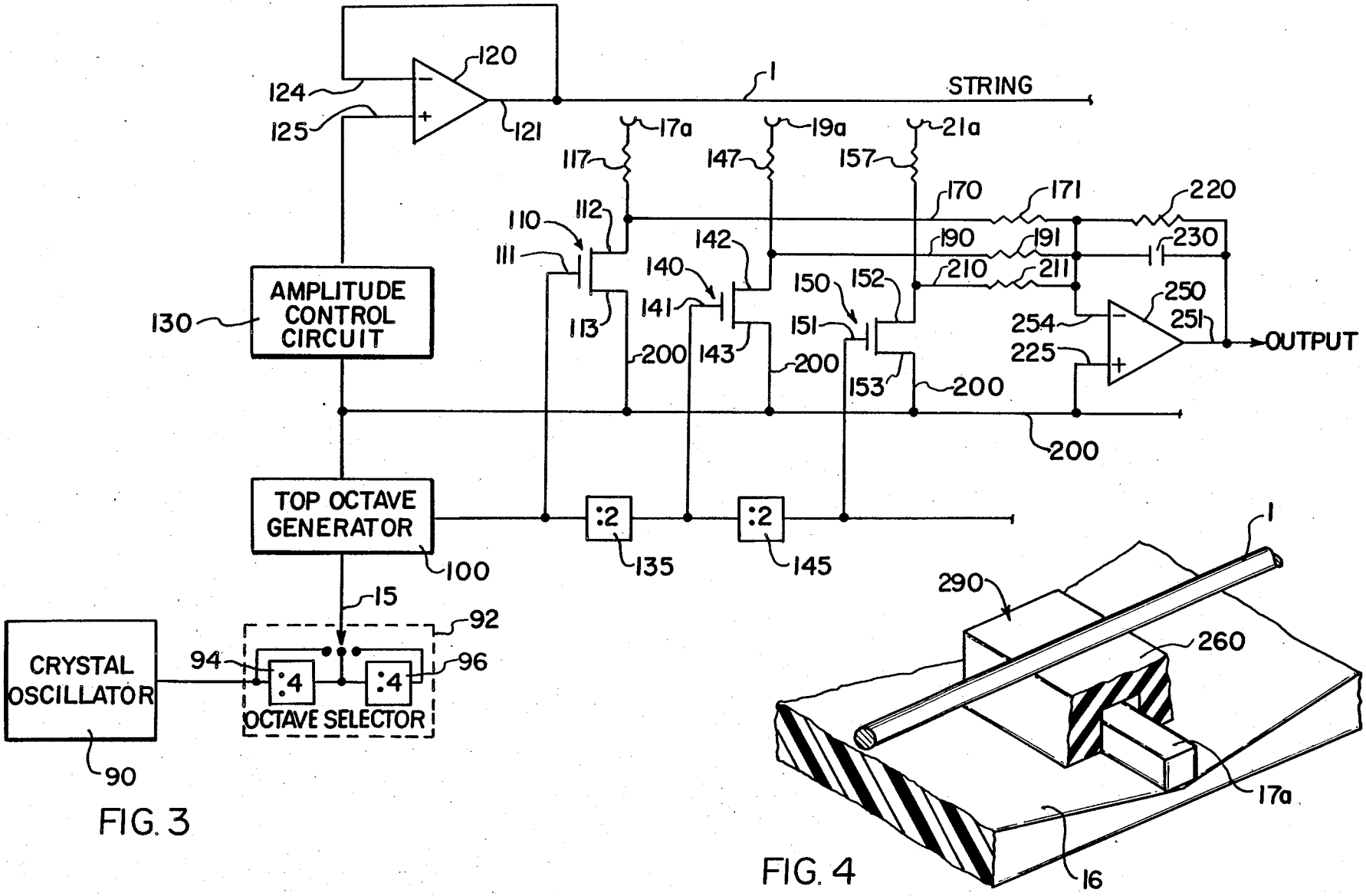
FIG. 3 is a schematic circuit diagram of an electrical circuit associated with one of the strings of the instrument.
FIG. 4 is an isometric view partially broken away of a conducting fret segment surrounded by a conducting elastomer material.

Referring specifically to FIG. 3, a schematic circuit diagram associated with string 1 is shown. Crystal osciallator 90 and octave selector 92 are connected to top-octave generator 100 to provide generator 100 with a particular octave range. Octave selector 92 includes dividers 94 and 96 and an octave selector switch 15. By manipulating switch 15 the user may instantly switch the frequency range of the instrument over the complete audible range. Top-octave generator 100 is connected to gate 111 of metal oxide semiconductor field effect transistor (MOSFET) 110. Drain 112 of MOSFET 110 is connected through resistor 117 to fret segment 17*a*. Source 113 of MOSFET 110 is connected to a common ground 200.

String 1, which is attached in spaced relationship with respect to fret segments 17*a*, 19*a* and 21*a*, is connected to output 121 of operational amplifier 120. String 1 is also connected to inverting input 124 of operational amplifier 120. An amplitude control circuit 130 is connected between noninverting input 125 of operational amplifier 120 and common ground 200.

Top-octave generator 100 provides fret segment 17*a* with an electrical signal of at least one known reference frequency.

A frequency divider 135 is provided between gate 111 of MOSFET 110 and gate 141 of MOSFET 140. Drain 122 of MOSFET 140 is connected to fret segment 19*a* through resisitor 137. Source 143 of MOSFET 140 is connected to common ground 200. Top-octave generator 100, provides fret segment 19*a* with an electrical signal which is a known fraction of the reference frequency signal provided to fret segment 17*a*.

Figure 5:
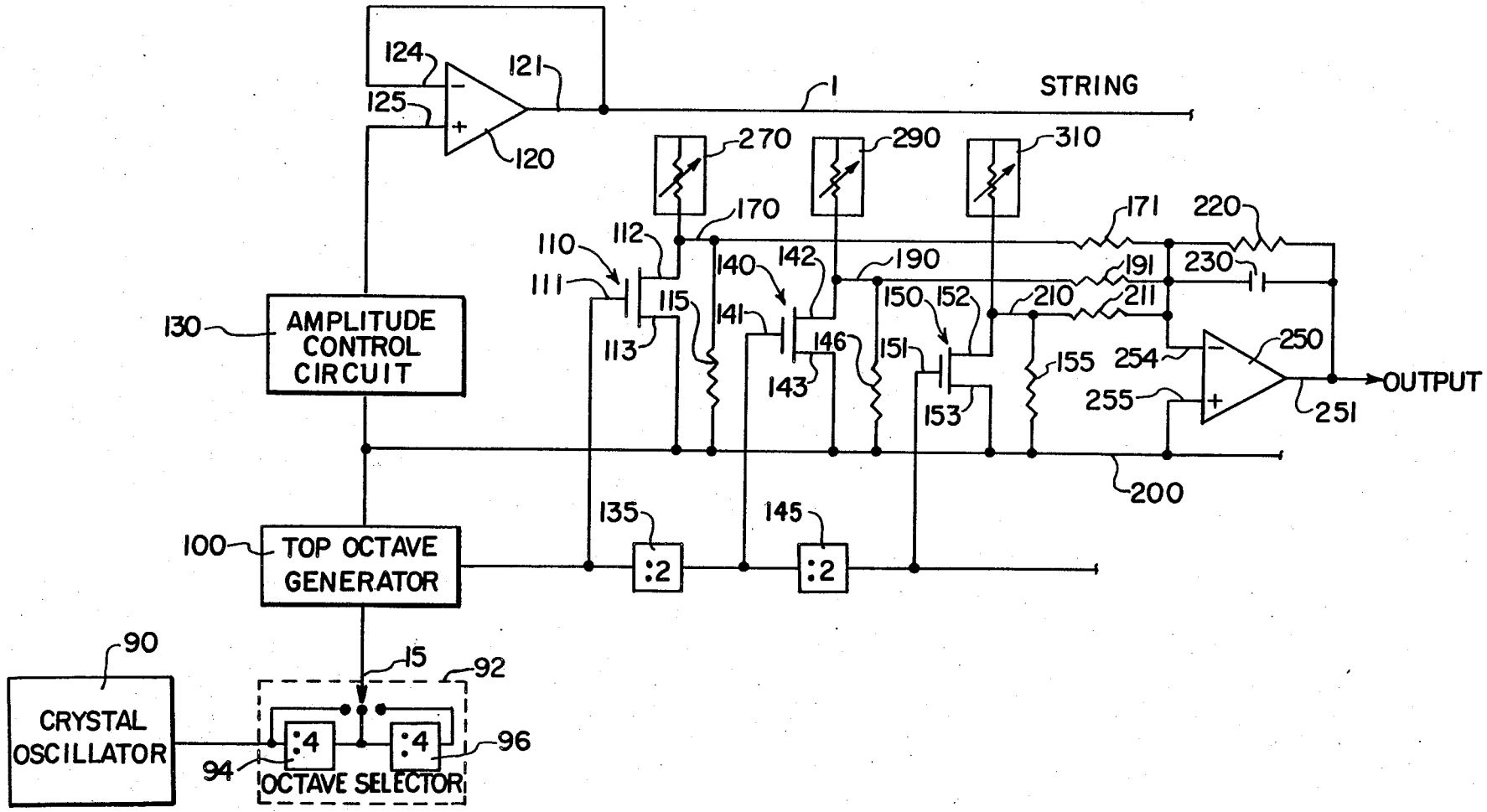
FIG. 5 is a schematic circuit diagram of an electrical circuit associated with one of the strings of the instrument in which a conducting elastomer is utilized to locally control the amplitude.

While FIGS. 3 and 5 show frequency dividers 135 and 145 as divide by two circuits and frequency dividers 94 and 96 as divide by four circuits, it may be appreciated that those numbers are illustrated in the drawing as being examples. It is to be understood, however, that the frequency dividers may be designed to provide any desired frequency division as the claimed invention is not limited solely to the specific fractions as indicated in FIGS. 3 and 5.

Similarly, frequency divider 145 is provided between gate 141 of MOSFET 140 and gate 151 of MOSFET 150. Drain 152 of MOSFET 150 is connected to fret 21*a* through resistor 157. Source 153 of MOSFET 150 is connected to common ground 200. Fret segment 21*a* is thereby provided with an electrical signal which is a known fraction of the frequency provided to fret segment 19*a*.

It will be understood by those skilled in the art that when string 1 is brought into contact with any one of fret segments 17*a*, 19*a* or 21*a* that a separate electrical circuit will be completed each having a different associated frequency. When string 1 is brought into contact with fret segment 17*a*, the voltage supplied by the amplitude control circuit will be applied across resistor 117. That voltage causes normally off MOSFET 110 to turn on thereby allowing the reference frequency to pass from gate 111 to drain 112. The reference frequency is then carried on line 170 through resistor 171 to inverting input 254 of operational amplifier 250. Similarly, fret 119*a* is connected to inverting input 254 through line 190 and resistor 191 and fret segment 21*a* is attached to inverting input 254 by line 210 and resistor 211. Noninverting input 255 of operational amplifier 250 is connected to the common ground 200. Resistor 220 and capacitor 230 are provided in parallel between inverting input 254 and output 251 of operational amplifier 250.

It is to be understood that only a portion of the present circuit is shown and that additional circuitry for additional fret segments must be provided. It is also to be understood that a separate amplitude control circuit is provided for each string on the instrument.

Means are provided for attaching each of the strings of the instrument in a spaced relationship with respect with its associated fret segments. Displacing a string to contact any fret segment completes an electrical circuit having a frequency substantially equal to the frequency provided to such fret segment. Displacing the same string to contact a different fret segment completes a different electrical circuit having a different frequency. Simultaneously depressing a plurality of the strings simultaneously completes a plurality of electrical circuits each circuit capable of producing a tone of a different frequency.

FIG. 3 illustrates the use of an amplitude control circuit 130. The present invention includes two presently preferred methods of providing the amplitude control circuit with an indication of a desired amplitude output. In each case, the amplitude of a circuit is responsive to the voltage applied to the string.

In a first embodiment, a plurality of pressure transducers, 1*b*, 2*b*, 3*b* and 4*b* one associated with each string is provided on the body of the instrument. The user of the instrument may depress the strings to contact desired fret segments with one hand while utilizing the other hand to depress appropriate pressure transducers. The greater the pressure applied to a particular transducer, the greater the amplitude of the output signal for its associated string. This is accomplished through the action of an "open drain" circuit (FIG. 5) as the output amplitude of this circuit is proportional to the voltage supplied by the contacting string.

Referring specifically to FIG. 4, an alternative method of providing control of amplitude is shown. Each fret segment, such as segment 17*a*, is provided with a suitable covering of a conducting elastomer 260. The fret segment assembly 290 is attached to insulating fingerboard 16. The electrical resistance of elastomer 260 changes according to the downward force applied by the string. This resistance change may in turn be utilized to control the loudness of that particular note. It may be desirable to provide an insulating layer over the string. In this application the string or a conducting ribbon must be pliable enough to accomodate greater deflections.

FIG. 5 illustrates the detail of a circuit in which a conductive elastomer is employed as a variable load resistor in an open drain configuration. The circuit of FIG. 5 is identical to the circuit shown in FIG. 3 except for the following differences. First, frets segments 17*a*, 19*a* and 21*a* and corresponding resistors 117, 147 and 157 are replaced with variable resistance elastomer covered fret segments 270, 290 and 310, respectively. As a result, the output amplitude on operational amplifier 250 becomes proportional to the voltage applied to string 1, and inversely proportional to the sum of the resistances of elastomers 270, 290 and 310 and input resistances 171, 191 and 211, respectively. The only remaining difference is that resistors 115, 146 and 155 may be provided between lines 170 and ground, 190 and ground and 210 and ground, respectively, to reduce interference with corresponding changes in the output signal.

It will be understood, therefore, that the present invention provides a stringed electronic instrument which is capable of playing plural notes simultaneously. Each string may provide several octaves of a particular musical not and several different strings may be simultaneously played to produce chords. The present invention also allows for the provision of amplitude control by the same circuit utilized to determine the frequency of any particular note. The present invention accomplishes these goals by utilizing a combination of oscillators, divider-keyers and segmented frets.

While I have shown and described certain present preferred embodiments of the present invention and have illustrated a present preferred method of practicing the same, it is to be distinctly understood that the invention is not limited thereto and may be otherwise variously embodied within the scope of the following claims.

I claim:

1. An electronic musical instrument comprising:

(a) a fingerboard having an electrically insulating upper surface and having a plurality of segmented frets attached across the surface at desired points along its length, each of said frets including a plurality of electrically conducting fret segments, each of said segments electrically insulated from one another;

(b) a plurality of elongated electrically conducting elements, each element disposed adjacent to and associated with a single fret segment of each of the frets;

(c) means for electrically charging said elements;

(d) plural frequency generator means one associated with a fret segment of a first one of frets for each associated conducting element for selectively providing each of said fret segments with an electrical signal of at least one known reference frequency;

(e) Divider means electrically interposed between adjacent fret segments of each associated conducting element along the length of the fingerboard for selectively providing each additional fret segment of each associated conducting element with a signal which has at least one frequency which is a known fraction of said reference frequencies; and (f) means for attaching each of said conducting elements to said instrument in spaced relationship with respect to its associated fret segments, whereby displacing an element to contact any fret segment completes an electrical circuit having at least one frequency equal to at least one frequency of the signal provided to such fret segment, displacing said element to contact a fret segment of a difference fret completes a different electrical circuit having at least one different frequency, displacing said element to contact a plurality of fret segments completes a plurality of electrical circuits producing a plurality of frequencies, and simultaneously depressing a plurality of conducting elements simultaneously completes a plurality of electrical circuits each capable of having a plurality of different frequencies.

2. An instrument according to claim 1 wherein each of said generator means provides a plurality of reference signals to said first fret segment.

3. An electronic musical instrument comprising:

(a) a fingerboard having an electrically insulating upper surface and having a plurality of segmented frets attached across the surface at desired points along its length, each of said frets including a plurality of electrically conducting fret segments, each of said segments Electrically insulated from one another;

(b) a plurality of elongated electrically conducting elements, each element disposed adjacent to and associated with a single fret segment of each of the frets;

(c) means for electrically charging said elements;

(d) plural frequency generator means one associated with a fret segment of a first one of frets for each associated conducting element for selectively providing each of said fret segments with an electrical signal of at least one known reference frequency;

(e) divider means electrically interposed between adjacent fret segments of each associated conducting element along the length of the fingerboard for selectively providing each additional fret segment of each associated conducting element with a signal which has at least one frequency which is a known fraction of said reference frequencies; and (f) means for attaching each of said conducting elements to said instrument in spaced relationship with respect to its associated fret segments, whereby displacing an element to contact any fret segment completes an electrical circuit having at least one frequency equal to at least one frequency of the signal provided to such fret segment, displacing said element to contact a fret segment of a different fret completes a different electrical circuit having at least one different frequency and simultaneously depressing a plurality of conducting elements simultaneously completes a plurality of electrical circuits each capable of having a plurality of different frequencies, wherein portions of said upper insulating surface extend upwardly at locations between adjacent frets along the length of the fingerboard to a point higher than that of said fret segments.

4. An instrument according to claim 3 wherein said upwardly extending portions of said upper surface each contacts a conducting element, whereby said element is maintained in a desired spaced relationship with respect to the fret segments.

5. An instrument according to claim 4 wherein said upwardly extending portions maintain said element between 0.005 and 0.02 inches above said fret segments.

6. An instrument according to claim 4 wherein said upwardly extending portions maintain said element approximately 0.01 inches above said fret segments.

7. An instrument according to claim 4 wherein said upwardly extending portions prevent undesired contact with adjacent fret segments of an associated conducting element along the length of the fingerboard when said element is depressed to contact a desired fret segment.

8. An instrument according to claim 1 further comprising an amplitude control means.

9. An electronic musical instrument comprising:

(a) a fingerboard having an electrically insulating upper surface and having a plurality of segmented frets attached across the surface at desired points along its length, each of said frets including a plurality of electrically conducting fret segments, each of said segments electrically insulated from one another;

(b) a plurality of elongated electrically conducting elements, each element disposed adjacent to and associated with a single fret segment of each of the frets;

(c) means for electrically charging said elements;

(d) plural frequency generator means one associated with a fret segment of a first one of frets for each associated conducting element for selectively providing each of said fret segments with an electrical signal of at least one known reference frequency;

(e) divider means electrically interposed between adjacent fret segments of each associated conducting element along the length of the fingerboard for selectively providing each additional fret segment of each associated conducting element with a signal which has at least one frequency which is a known fraction of said reference frequencies;

(f) means for attaching each of said conducting elements to said instrument in spaced relationship with respect to its associated fret segments, whereby displacing an element to contact any fret segment completes an electrical circuit having at least one frequency equal to at least one frequency of the signal provided to such fret segment, displacing said element to contact a fret segment of a different fret completes a different electrical circuit having at least one different frequency and simultaneously depressing a plurality of conducting elements simultaneously completes a plurality of electrical circuits each capable of having a plurality of different frequencies; and (g) amplitude control means, wherein the amplitude of a circuit is responsive to the voltage of the electrical charge applied to an electrical conducting element.

10. An instrument according to claim 8 wherein said amplitude control means includes a plurality of pressure transducers, one associated with each conducting element.

11. An electronic musical instrument comprising:

(a) a fingerboard having an electrically insulating upper surface and having a plurality of segmented frets attached across the surface at desired points along its length, each of said frets including a plurality of electrically conducting fret segments, each of said segments electrically insulated from one another;

(b) a plurality of elongated electrically conducting elements, each element disposed adjacent to and associated with a single fret segment of each of the frets;

(c) means for electrically charging said elements;

(d) plural frequency generator means one associated with a fret segment of a first one of frets for each associated conducting element for selectively providing each of said fret segments with an electrical signal of at least one known reference frequency;

(e) divider means electrically interposed between adjacent fret segments of each associated conducting element along the length of the fingerboard for selectively providing each additional fret segment of each associated conducting element with a signal which has at least one frequency which is a known fraction of said reference frequencies;

(f) means for attaching each of said conducting elements to said instrument in spaced relationship with respect to its associated fret segments, whereby displacing an element to contact any fret segment completes an electrical circuit having at least one frequency equal to at least one frequency of the signal provided to such fret segment, displacing said element to contact a fret segment of a different fret completes a different electrical circuit having at least one different frequency and simultaneously depressing a plurality of conducting elements simultaneously completes a plurality of electrical circuits each capable of having a plurality of different frequencies; and (g) amplitude control means, wherein said amplitude control means includes a conducting elastomer provided over each of said fret segments.

12. An instrument according to claim 11 wherein said conducting elastomer, when contacted by an element with a varying force, is adopted to provide a varying resistance in a completed circuit which is utilized to control said circuit's amplitude.

13. An instrument according to claim 1 wherein said conducting element is a string.

14. An instrument according to claim 1 wherein said conducting element is a ribbon.

15. An instrument according to claim 3 wherein said conducting element is a string.

16. An instrument according to claim 15 wherein an uppermost portion of said upwardly extending portions is provided with at least one channel-like groove therein extending substantially parallel with respect to an associated string to prevent an undesired degree of motion of said string in a direction transverse with respect to a downward depression of said string.

17. An instrument according to claim 1 further comprising octave selector means.

18. An instrument according to claim 17 wherein said octave selector means allows the user to instantly shift the frequency range of the instrument over the complete audible range.

* * * * *